US005301723A

United States Patent [19]

Goode

[11] Patent Number: 5,301,723

[45] Date of Patent: Apr. 12, 1994

[54] APPARATUS AND METHOD OF PREVENTING ICE ACCUMULATION ON COUPLING VALVES FOR CRYOGENIC FLUIDS

[75] Inventor: John E. Goode, Arlington, Tex.

[73] Assignee: Hydra Rig, Inc., Fort Worth, Tex.

[21] Appl. No.: 973,159

[22] Filed: Nov. 6, 1992

[51] Int. Cl.[5] ..... B65B 3/04

[52] U.S. Cl. ..... 141/82; 141/11; 141/59; 141/231; 141/382; 141/383; 141/69; 141/346; 62/82

[58] Field of Search ..... 141/82, 11, 59, 44–46, 141/231, 382, 383, 387, 384, 386, 346–355, 89–92, 69, 70; 62/65, 78, 82

[56] References Cited

U.S. PATENT DOCUMENTS

| | | | |
|---|---|---|---|
| 3,045,721 | 7/1962 | Shepherd et al. | 141/346 |
| 3,086,565 | 4/1963 | Mosher | 141/347 |
| 3,863,688 | 2/1975 | Millar et al. | 141/59 |
| 4,098,303 | 7/1978 | Gammell | 141/70 X |
| 4,489,767 | 12/1984 | Yamada | 141/48 |
| 4,582,100 | 4/1986 | Poulsen | 141/82 X |
| 4,827,992 | 5/1989 | Mörsky et al. | 141/11 |
| 5,094,277 | 3/1992 | Grant | 141/82 X |

*Primary Examiner*—Ernest G. Cusick
*Attorney, Agent, or Firm*—Marc A. Hubbard

[57] ABSTRACT

An LNG refueling facility includes a nozzle for mating with the receptacle on a motor vehicle to deliver a flow of LNG to the vehicle's tank. The nozzle is supplied with a flow of dry gas to purge moisture-laden air from around surfaces which mate with the receptacle to prevent freezing of moisture on the mating surfaces when the nozzle turns very cold. The nozzle also includes a boot enclosing mechanical linkages for latching the nozzle to the receptacle. Dry gas is supplied to the interior of the boot to displace air from around the mechanical linkages and thereby prevent moisture from freezing onto the mechanical linkages.

23 Claims, 4 Drawing Sheets

APPARATUS AND METHOD OF PREVENTING ICE ACCUMULATION ON COUPLING VALVES FOR CRYOGENIC FLUIDS

FIELD OF THE INVENTION

The invention pertains generally to disconnectable couplings for cryogenic fluids, and more particularly to preventing formation of ice on coupling valves for dispensing liquified natural gas into vehicles.

BACKGROUND OF THE INVENTION

Interest in the use of liquid natural gas (LNG) as a motor vehicle fuel has increased dramatically in recent years. Whole fleets of government and industry vehicles have successfully been converted to natural gas, and some private individuals have converted their vehicles as well. Congress recently passed an energy bill which would require further increased use of alternative fuels in government and private fleets.

Several factors have influenced this increasing interest in natural gas as a motor vehicle fuel. LNG is relatively inexpensive. It also burns very cleanly, making it much easier for fleets to meet more restrictive pollution emission standards. However, handling LNG remains a significant problem.

Vehicles using LNG in place of gasoline are equipped with a cryogenic tank in place of an ordinary gas tank. A cryogenic tank is very well insulated and sealed. It is able to maintain the LNG at sufficient low temperatures for a period of time sufficient for a fleet vehicle to burn most of the LNG before significant vaporization occurs.

LNG fueling facilities are high capacity facilities generally designed to service large fleets of vehicles. A conventional LNG fueling station includes massive LNG storage tank, a pump for pumping the LNG, and a dispensing mechanism that includes a nozzle assembly that is used to connect and to disconnect quickly an LNG line to and from the cryogenic tank on the vehicle. The nozzle assembly includes a connector that is designed to quickly couple to and uncouple from a complementary connector on a receptacle on the vehicle's tank. Because LNG in its gaseous or vapor state is potentially explosive when mixed with air, valves located in each receptacle assure that no LNG or gaseous methane escapes from either of the connectors prior to complete coupling. Upon proper coupling, the valves are automatically displaced from their respective valve seats to allow LNG to flow in the vehicle's tank. A locking mechanism insures that the coupling halves are locked together prior to the opening of the valves and to prevent accidental disconnection of the receptacles during pumping.

LNG flowing through the nozzle assembly rapidly cools its exterior surface. Moisture in the atmosphere tends to condense and to freeze on the nozzle assembly. The ice is extremely undesirable, as it interferes with coupling of the nozzle to the receptacle on the motor vehicle. Ice also tends to form between the nozzle and the receptacle. Any ice that has accumulated on the nozzle assembly melts quickly at points of contact with the warmer receptacle. The moisture, in a liquid state, then spreads quickly and evenly. When cryogenic methane begins to flow through the receptacle, the moisture quickly re-freezes and effectively glues together the coupling, making it very difficult to detach the nozzle assembly from the vehicle receptacle. The ice can also form on the mechanical linkages of the latching mechanism, making it difficult to unlatch the nozzle.

The conventional solutions of removing ice are certainly inconvenient and, in the case of the hammer, potentially destructive and dangerous. Furthermore, breaking or melting of the ice is time consuming and slows refueling. Since LNG stations tend to be expensive to install and maintain, fleet operators often demand that LNG stations be capable of refueling at a rate of one vehicle every few minutes. Ice formation is thus an impediment to efficient operation of LNG refueling stations. It also discourages use of LNG dispensing stations by persons who are not specially trained, such as retail consumers, and therefore impedes more widespread acceptance of LNG as a fuel for motor vehicles.

BRIEF SUMMARY OF THE INVENTION

The invention overcomes the problems of ice formation on quick-disconnect couplings through which LNG flows and has several advantages over previous approaches to dealing with the problems of ice formation, particularly on nozzles, at LNG stations for dispensing into motor vehicles.

The invention prevents ice formation on a coupling by displacing moisture-laden air around critical exterior surfaces of a quick-disconnect coupling with a dry gas. The dry gas envelops the mating surfaces of the coupling. The gas must be free from moisture and other substances that would freeze on contact. Preferably, the source of the gas is vapor from a cryogenic liquid or other cryogenic source. The vapor is thus assured to be dry and free from other substances having much high freezing points. The cryogenic fluid flowing through the coupling may in fact be used as a source of the dry gas, as some vaporization of the cryogenic fluid always occurs in a cryogenic system. A source of suitable purging gas, having an acceptable purity and freezing point, is thus always present when the cryogenic fluid is being flowed through the coupling. However, if release of the vapor from the cryogenic fluid is undesirable, an acceptable alternate source of dry gas may be used.

In the preferred embodiment for a nozzle assembly for dispensing LNG into vehicles, dry gas flows into a connector on a nozzle assembly of the LNG dispensing mechanism and into a boot structure surrounding the mechanical linkages of a latching mechanism on the nozzle assembly. The flow displaces the atmosphere adjacent the mating surfaces of the nozzle's connector, as well the mating surface of the receptacle on the vehicle's tank as the nozzle approaches the tank's receptacle. Because of the flammable nature of methane, a small tank of liquid or compressed nitrogen may be used to supply purging gas.

The forgoing is intended merely as a brief summary of the invention and certain of its aspects and advantages. Its various objects, advantages and aspects, are described with reference to, or will be readily apparent to ordinarily skilled artisans from, the annexed drawings illustrating the preferred embodiment of the invention. Furthermore, the scope of the invention is set forth in and limited only by the claims which follow the detailed description. Neither this summary nor the following description of the preferred embodiment of the invention is to be construed as limiting the scope of the invention.

Figure 2:
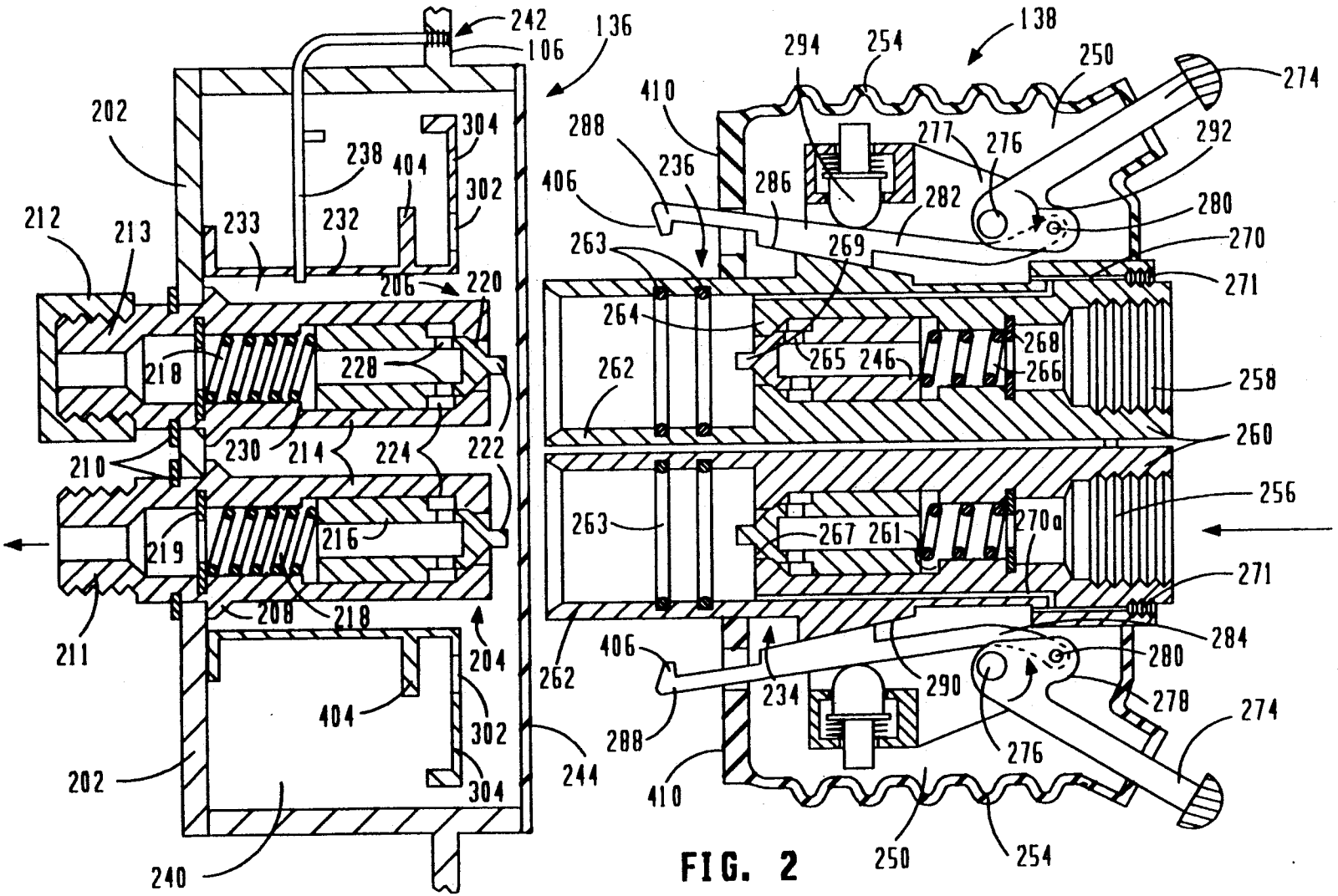
FIG. 2 is a cross-section of a fueling nozzle receptacle on the dispenser illustrated in FIG. 1 and a fueling nozzle.
Figure 3:
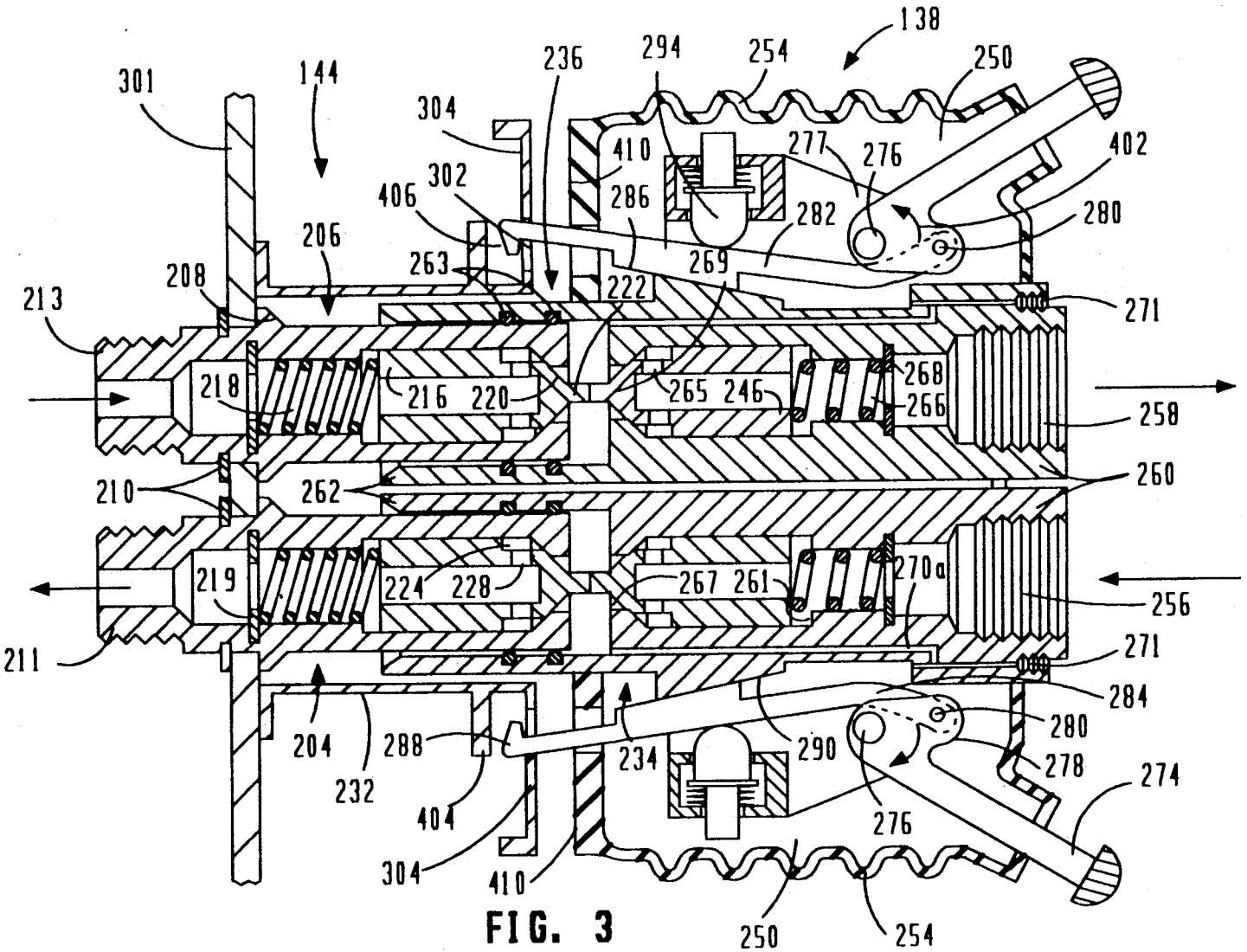
FIG. 3 is a cross-section of a fueling nozzle docking with a receptacle on a motor vehicle for refueling.
Figure 4:
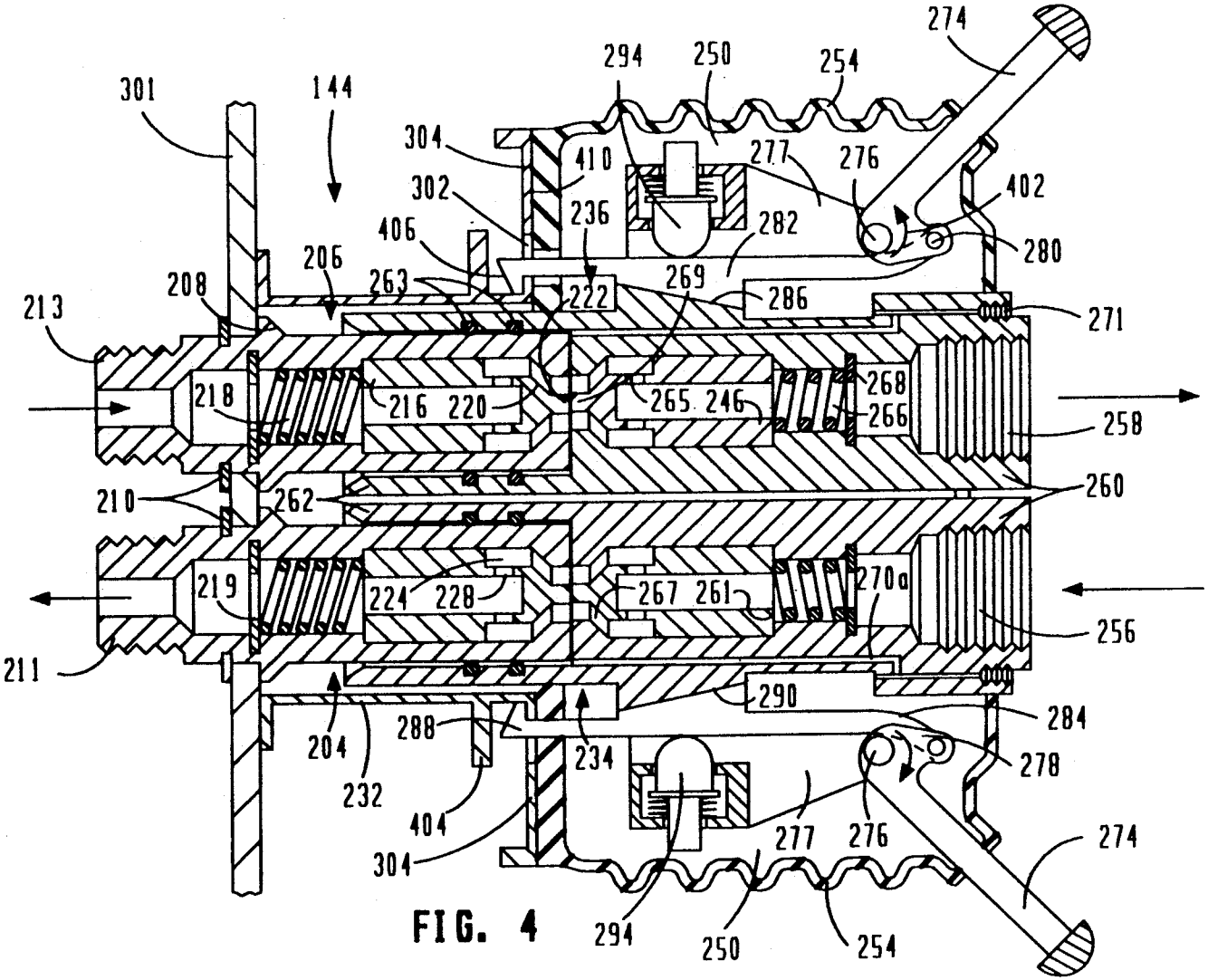
FIG. 4 is a cross-section of the fueling nozzle latched to the receptacle on the motor vehicle after docking is completed to allow dispensing of LNG into vehicle to begin.

Please note that, because of space restrictions in FIGS. 2–4, only one of multiple like parts on the same drawing will be, in some cases, referenced with a numeral, due to the density of the illustrated parts. Where there are different numerals applying to otherwise like parts, it is to distinguish between symmetrical sides of the fueling nozzle.

DETAILED DESCRIPTION OF THE PREFERRED EMBODIMENT

In the following description, like numbers refer to like elements.

Figure 1:
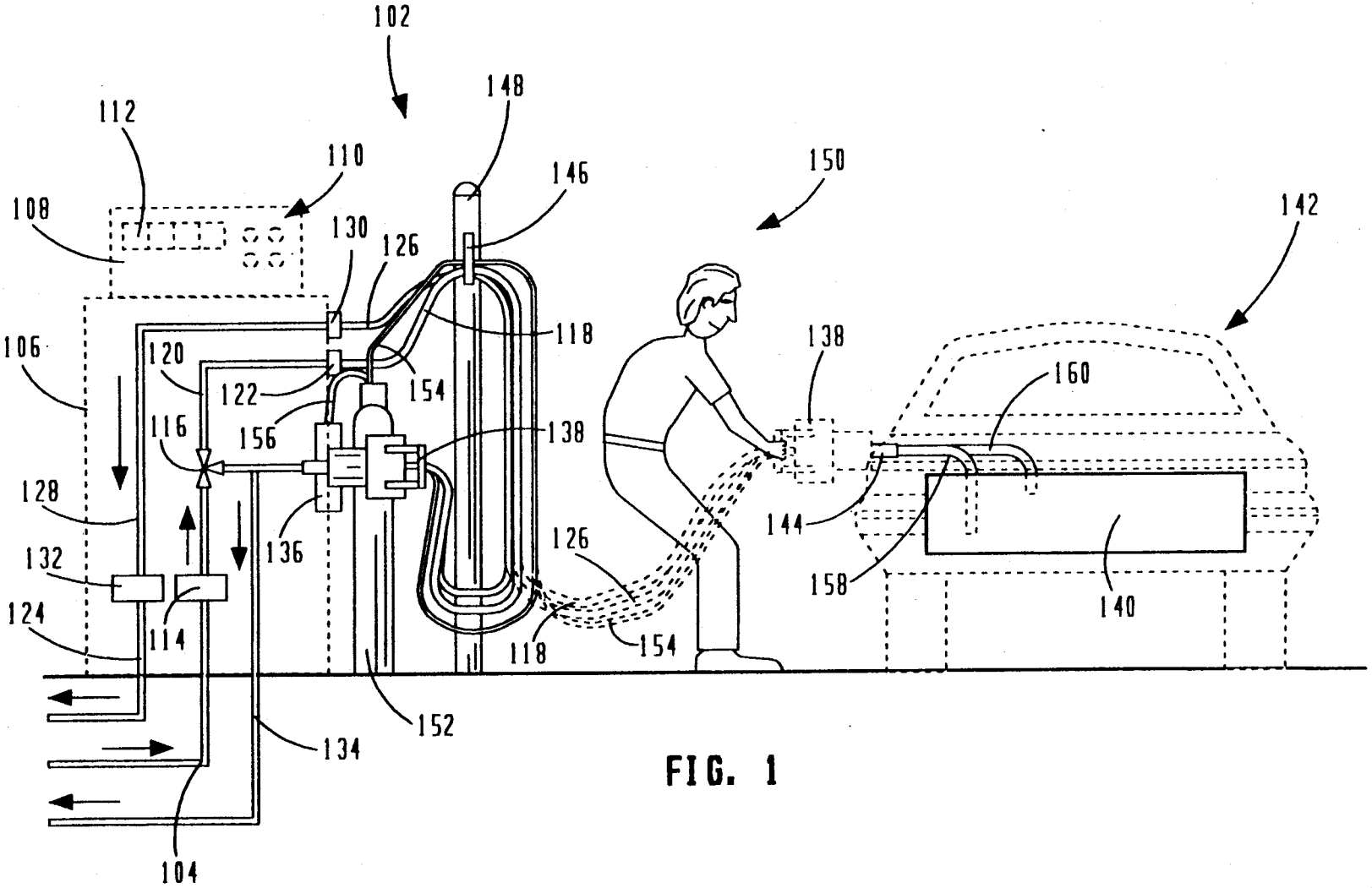
FIG. 1 is a simplified illustration of an liquified natural gas (LNG) fueling station.

Referring to FIG. 1, a liquified natural gas (LNG) fueling station includes dispenser 102, a cryogenic tank or vessel for storing a supply of LNG (not shown) and a pump (not shown) for pumping LNG from the tank to the dispenser 102 through a supply line 104. Dispenser 102 includes a housing 106, and a control panel 108, both indicated in phantom for clarity. The control panel includes a plurality of buttons 110 for controlling dispensing operations. Visual display 112 indicates the volume of LNG dispensed from dispenser 102 as measured by liquid flow meter 114, as well as warning and advisory messages. LNG supply line 104 is coupled to three-way valve 116. One output of valve 116 couples a flow of LNG from line 104 to a flexible hose 118 through line 120 and fitting 122. LNG return line 134 is connected to the cryogenic tank. Return line 134 is connected to dispenser receptacle 136, as well as to three-way valve 116. Vent line 124 returns natural gas in its vapor phase, vented from vehicle fuel tank 140, to a venting system (not shown) associated with a cryogenic tank. Vent line 124 is coupled to line 128, which in turn is connected to flexible hose 126 with fitting 130. A gas flow meter 132 measures the flow rate of natural gas vented through flexible hose 126 to vent line 124. Fueling hose 118 and venting hose 126 are each connected to fuel nozzle 138. Dispenser 136 receives fueling nozzle 138 and establishes fluid communication between fueling hose 118 and return line 134.

Dispenser 102 has three basic modes of operation. In a first mode of operation, three-way valve 116 is opened to allow a flow of LNG from supply line 104, past liquid flow meter 114 and into return line 134. In this mode of operation, liquid flow meter 114 can be calibrated and cooled with LNG. Cooling flow meter 114 reduces vaporization. The phase of the LNG is thus more homogenous, allowing for more accurate measurement of initial flows by the flow meter. In a second mode of operation, referred to as pre-cooling, the position of three-way valve 116 is moved to communicate a flow of LNG from supply line 104, through line 120, to hose 118. As fueling nozzle 138 is coupled to dispenser receptacle 136, the LNG then flows through the fueling nozzle 138 into receptacle 136 and into return line 134. Circulation of LNG through the fueling nozzle 138 and cools line 120, hose 118 and fueling nozzle 138. Precooling of these elements reduces vaporization of LNG as it is being dispensed. A more homogenous phase is delivered, allowing for a more accurate measurement of the actual amount of LNG dispensed into the vehicle to be obtained and helping to insure that a saturated liquid phase of the cryogenic methane is delivered to the vehicle tank.

The third mode of operation is dispensing of LNG into cryogenic tank 140 located in a vehicle 142. In this mode, as indicated by dashed lines, fueling nozzle 138 has been removed from receptacle 136 and placed onto a vehicle receptacle 144. Hoses 118 and 126 are suspended above the ground with bracket 146 on post 148 to allow easy manipulation of the fueling nozzle 138 by person 150. Once fueling nozzle 138 is coupled to vehicle receptacle 144, LNG flows through hose 118, through fueling nozzle 138 and into tank 140 through line 158. Gaseous methane is vented from tank 140 through vent line 160 and collected by fueling nozzle 138. From nozzle 138, the vented gas flows through flexible hose 126 into line 128. Gas flow meter 132 measures the amount of gas vented from tank 140 and subtracts it from the total mass of LNG dispensed into vehicle 142 to obtain an accurate measurement of LNG in tank 140.

Tank 152 holds a supply of purging gas. Purging gas is supplied with line 154 to fueling nozzle 138. Purging gas is also supplied through hose 156 to dispenser receptacle 136. The purging gas, because it will be vented to atmosphere, is an inert gas such as nitrogen ($N_2$). However, natural gas, vented from the LNG storage tank, may be used if permitted by state and federal regulations. In this case, tank 152 would not be necessary. A line could be run from the venting mechanism associated with the LNG storage tank to a temporary holding tank from which the flow of purging gas is drawn. If used in small enough quantities, venting methane into the atmosphere may not pose a risk of explosion.

Referring now to FIG. 2, fueling nozzle 138 is shown as it is being removed from dispenser receptacle 136 located on fuel dispenser 102 (FIG. 1). Dispenser receptacle 136 is recessed within housing 106 of the dispenser. Extending through holes defined in rear receptacle wall 202 are male connectors 204 and 206. Male connector 204 is attached to LNG return line 134 (see FIG. 1) with threaded end 211; connector 206 is sealed with cap 207 screwed onto threaded end 213. Each of the male connectors are the same. Therefore, reference is made in this description only to one of the connectors. A flange portion 208 of the connector is retained against the exterior of wall 202 with a ring 210. The male connector includes a cylindrically-shaped male connector body 214 having a hollow interior and a circular inner diameter. A valve 216 is disposed in the interior of body 214 and has a distal end shaped to fit snugly against the inner diameter of the body to insure alignment with valve seat 220. A compressed spring 218, retained by a ring 219 forces a proximal end of the valve against a valve seat 220 to close the valve. A force applied to a nipple portion 222 sufficient to overcome the compressive force of spring 218 displaces valve 216 and allows fluid to flow through valve opening 226 and into annular cavity 224. From the annular cavity, fluid is allowed to flow into the interior of body 214 through ports 228. A shoulder 230 extending from the inner surface of the connector body stops displacement of the valve 216.

Male connectors 204 and 206 are located within a compartment 233 formed by walls 232. As male connector 204 becomes very cold due to the flow of LNG circulating through the dispenser during pre-cooling, moisture in the air could freeze to the exterior of male connector 204, once fueling nozzle 138 is removed from dispenser receptacle 136 for dispensing. Ice on the male connectors may not have time to thaw and the water evaporate before fueling nozzle 138 is docked to the receptacle for pre-cooling between dispensing operations. Purge line 238 supplies a flow of gas to compartment 233, as well as to space 240 between the walls 232 of the compartment and housing 106, displacing or purging air from compartment 233 and thereby reducing the opportunity for ice formation on the male connector 204. The purge line is connected by threaded fitting 242 to hose 156 (FIG. 1), which is in turn connected to tank 152 (FIG. 1). The volume of the compartment 233 is preferably kept relatively small to reduce the amount of purging gas required. The relatively small volume of the compartment also assists the purging gas in displacing air containing moisture from around male connectors 204 and 206. Flap 244, shown in a closed position, further enhances purging by allowing purging gas to build up in the compartment 233 while permitting displaced air to escape. The flap is connected to the housing 106 is some manner to allow it to be swung or moved into the closed position after removal of fueling nozzle 138, and to an open position to allow fueling nozzle 138 to dock with dispenser receptacle 136. Alternately, instead of moving the flap out of the way, one or more slits may be incorporated in the flap, through the female connectors and or entire nozzle may be pushed. The flap is a rubber material, but may be made of metal or other material if desired. It does not seal tightly against housing 106 so as to permit air displaced by purging gas to exit the compartment 233 and space 240.

Referring briefly now to FIGS. 3 and 4, vehicle receptacle 144 on the vehicle is shown in place of dispenser receptacle 136. Vehicle receptacle 144 is essentially identical to vehicle receptacle 144. Consequently, the same reference numbers are applied to the shared components of the receptacles, and no description of the elements so referenced is repeated. Nevertheless, there are several differences. Vehicle receptacle 144 has no need for its own purging system since it is not pre-cooled and ice will have sufficient time to melt during vehicle usage before docking again with the fueling nozzle. Furthermore, both male connectors are used: threaded end 211 of male connector 204 is connected to line 158 (FIG. 1) for delivering LNG to tank 140 (FIG. 1); and threaded end 213 of male connector 206 is connected to vent line 160 (FIG. 1) for venting gas phase methane from the tank.

Referring now to FIGS. 2–4 for a description of fueling nozzle 138, the fueling nozzle has four major components: female connectors 234 and 236; right and left latching handle assemblies 250 and 252, respectively; and boot 254. To threaded ends 256 and 258 of female connectors 234 and 236 are connected, respectively, to hose 118 (FIG. 1) for carrying LNG and hose 126 (FIG. 1) for carrying gas vented from vehicle fuel tank 140 (FIG. 1).

Female connectors 234 and 236 are essentially identical in structure and function. Therefore, reference to only one female connector will be made. The female connector includes a body 260. The hollow body includes cylindrically shaped flange portion 262 that is designed to closely fit around the exterior of body 214 of the corresponding male connector 204 or 206. A pair of seals 263 disposed within a channel formed along the inner periphery or surface of the body provide a seal between the body 260 and the exterior surface of body 214. Female connector body 260 also includes a circular lip portion 264 extending inwardly that forms a valve seat having a back surface conforming to the surface of piston-like valve 246 to create a good seal. Valve 246 moves linearly between a closed position against lip 264 and a fully open position against shoulder 261. The portion of body 260 carrying the valve is shaped and sized to snugly fit against the valve. Compressed spring 266, retained within the body by ring 268, applies a closing force to the valve to seat the valve against lip 264. The valve is displaced by force applied to nipple 269 on top of the valve. When the valve is displaced, fluid is allowed to flow through annular opening 267 and then through ports 265 into the hollow center of valve 246 and body 260.

A flow of LNG through fueling nozzle 138 turns the nozzle very cold. Consequently, after removal of the fueling nozzle from one of the receptacles 136 or 144, moisture in the air will tend to freeze on the mating surfaces of the fueling nozzle, particularly the interior surfaces of flange 262 and around valve 246. This ice will impede subsequent docking of the fueling circular lip portion 264 nozzle with another vehicle receptacle 144 or with dispenser receptacle 136. As the fueling nozzle is intended to undock for only short periods of time, and to quickly redock, this is a significant problem. A flow of dry purging gas is delivered to the interior of flange 262 through purge line 270 and branch 270*a*. The flow of purging gas displaces air from around the mating surfaces, thereby tending to prevent freezing of moisture. Purge line 270 is connected by threaded receptacle 272 to line 155 (FIG. 1) for receiving a flow of purging gas. This flow of purging gas into the interior of flange 262 also tends to displace air from around the male connectors 204 and 206 of vehicle receptacle 144 during docking to prevent trapping of air having moisture between the male and female connectors that will subsequently freeze.

The right and left latching handle assemblies 250 and 252 are essentially identical in structure and function. In the following description, reference will be made to only one. The latching handle assembly is mounted on a bottom back plate 277, on which female connectors 236 and 234 are also mounted. Handle 274 rotates about pivot 276. Pivot 276 is fixed to back plate 272. Handle 274 includes a lever portion 278. Pivot 280 is fixed to the lever portion. Latching arm 282 includes a linkage portion 284, a canted surface portion 286 and hook 288. Linkage portion 284 is attached for rotation to pivot 280. Canted surface portion 286 cooperates with sloped face 290 of body 260. A spring loaded piston 294, mounted to bottom back plate 277, pushes canted surface portion 286 against sloped face 290. The canted surface and sloped face cooperate, under the force of the piston, to move hook 288 forwardly and outwardly when latch arm 272 are is moved forwardly by rotation of handle 274 in the direction of arrow 292. Canted surface portion 286 tends to pivot slightly against sloping face 290, as shown.

Latching mechanisms 250 and 252 are enclosed by a boot 254 made from flexible material capable of generally holding the purging gas or permitting a small flow of purging gas to escape. The boot includes openings for the handles 274 and the end of latching arms, through which displaced air is allowed to escape. The material of the boot may also be porous enough to allow escape of the air. Through purge line 270, a flow of purging gas displaces air within the boot and fills the boot with the purging gas. Enveloping the exterior surfaces of the latching mechanisms 250 and 252 prevents moisture in the air from freezing to linages, pivots and other cooperating surfaces of the latching mechanisms when a flow of LNG through the nozzle cools the entire nozzle.

Referring now to FIG. 3 only, docking of the fueling nozzle 138 with vehicle receptacle 144 is illustrated. Vehicle receptacle 144 is mounted on a bulkhead 301 of vehicle 142 (FIG. 1). Docking of the fueling nozzle with receptacle 136 on the dispenser 102 (see FIGS. 1 and 2) is identical, and therefore will not be separately described. Person 150 (FIG. 1) maneuvers fueling nozzle 138 to the receptacle by gripping left and right handles 274 and moving them inwardly, in the direction indicated by arrows 292, to move hooks 288 forwardly and outwardly with respect to female connectors 234 and 236. As cylindrical flange portions 262 approach male connectors 204 and 206, a flow of purging gas displaces air from around the male connectors. The cylindrical flanges then fit over and slide onto the bodies 214 of the male connectors, as shown. Hooks 288 are aligned with, and extend through, slots 302 formed in walls 304. Each of the nipples 269 on the fueling nozzle are just touching corresponding nipples 222 on the receptacle. None of the valves 216 and 246 have been displaced. Seals 263 have sealed male connectors 204 and 206 to female connectors 234 and 236, respectively. The nipples are displaced upon further sliding of the female connectors over the male connectors caused by motion of the handles 274 in the direction of arrows 402. Rotation of the handles causes each hook 288 to engage wall 304. Further rotation pulls the fueling nozzle 138 onto vehicle receptacle 144. The valve having the weaker biasing spring will open first. The springs may be chosen to ensure that a particular valve opens first, if desired. Seals 263 prevent fluid spillage of LNG and vent gas from around male connectors 204 and 206, respectively, in the event valve 246 on female connector 234 and valve 216 on male connector open before the valve with which they mate opens to receive the flow of LNG or vent gas.

Referring now to FIG. 4, fueling nozzle 138 is shown fully docked and latched to vehicle receptacle 144. The final stages of docking, as well as latching and undocking, are the same for receptacle 136, and therefore these procedures will be described with reference only to vehicle receptacle 144.

During final stages of docking, as fueling nozzle 138 is pulled onto vehicle receptacle 144 with hooks 288. Each hook includes a canted or oblique face 406 to help to find and to push the hooks through slots 302 without the forward surface of the hooks from catching wall 304. As the left and right latching mechanisms 250 and 252 are identical, reference will be made to only one. The hook is then pulled backwardly and inwardly by rotation of handle 274 in the directions shown by arrow 402. As the hook grabs wall 304, continued rotation of the handle pulls fueling nozzle 138 toward the receptacle. The handle thus provides leverage for assisting docking. This leverage is helpful where seals 263 provide a very tight fit between the outer diameter of male connectors 204 and 206 and the inner diameter of cylindrical flanges 262.

To latch the fueling nozzle, the handle 274 is rotated until elbow 408 of the latching arm 282 hits against pivot 276. Rotating handle 274 to this point moves pivot 280 slightly outside the direction of force applied by the latching arm 282 to wall 304, taking advantage of the pulling force exerted along latching arm 282 to hold the handle in a fully-outwardly rotated position.

When docking and latching is completed, face 410 of boot 254 is flush against wall 304 to assist in trapping purging gas in compartment 233 that has flowed from branch **270*a* and into the compartment during earlier stages of docking. The flush fit also assists in preventing moisture-laden air from entering the compartment. Valves 216 and 246 are both fully open to allow flow of LNG through female connector 234 and into through the male and female connectors, seals 263** create a seal between the male and female connectors.

To unlatch the fueling nozzle, handle 274 is moved in the direction opposite of that indicated by arrow 402, causing hook 288 to move first outwardly and then forwardly. Once hook 288 hits tab 404, continued rotation of the handle acts to push fueling nozzle 138 away from vehicle receptacle 144. The leverage supplied by the handle assists in removing the fueling nozzle in the event some ice does form around the mating surfaces (the exterior surface of body 214 and interior surface of cylindrical flange 262) of the connectors or between the exterior of the female bodies 260 and walls 232.

Although preferred embodiments of the invention have just been described and are illustrated in the accompanying drawings, it will be understood that the invention is not limited to the embodiments disclosed, but is capable of numerous rearrangements, modifications, and substitutions of parts and elements without departing from the spirit of the invention. Accordingly, the present invention is intended to encompass such rearrangements, modifications, and substitutions of parts and elements as fall within the scope of the invention.

What is claimed is:

1. A quick-disconnect coupling for use in a cryogenic system having mating components for establishing a connection between two lines for transferring cryogenic fluid from one line to the other without ice forming on mating surfaces of the components, the quick-disconnect coupling comprising:

a first connector coupled to a first line and having a first mating surface;

a second connector coupled to a second line for carrying a flow of cryogenic fluid, the second connector having a second mating surface configured for mating with the first connector and establishing a disconnectable seal for communication of the flow of cryogenic fluid from the second line to the first line; the second connector including a passage for supplying a flow of dry purging gas to the second mating surface for displacing moisture-laden air from around the second mating surface, thereby preventing moisture in air from freezing onto the second mating surface when the second connector is very cold due to flow of cryogenic fluid.

2. The quick-disconnect coupling of claim 1 wherein second connector includes a sleeve adapted for receiving within an interior spaced defined by inside surfaces of the sleeve an extension of the first connector, the second mating surface including the inside surfaces of the sleeve; and wherein the passage includes an opening to the interior of the sleeve for delivering a flow of purge gas to the interior of the sleeve tending to displace moisture-laden air from adjacent the inside surfaces of the sleeve.

3. The quick-disconnect coupling of claim 2 wherein the flow of purge gas to the interior of the sleeve tends to displace air from adjacent the first mating surfaces of the first connector during coupling of the first connector with the second connector.

4. The quick-disconnect coupling of claim 1 further including a latch for securing coupling of the first connector with the second connector, the latch being adjacent an opening for receiving a flow of dry purging gas, the flow of purging gas tending to displace moisture-laden air from around working surfaces of the latch and to prevent freezing of moisture on the working surfaces that would interfere with unlatching.

5. The quick-disconnect coupling of claim 4 wherein the latch further including at least a partial enclosure for assisting trapping of purge gas around working surfaces of the latch while allowing purging of air displaced by the purging gas.

6. The quick-disconnect coupling of claim 1 wherein the dry purging gas is the cryogenic fluid in its vapor phase and is collected from vaporization of the cryogenic fluid in the cryogenic system.

7. A nozzle for dispensing liquified natural gas (LNG) into vehicles, the nozzle cooperating with a receptacle on a vehicle running on LNG for delivery of LNG from a supply tank into a tank on the vehicle, the nozzle comprising:

a connector coupled to a line for carrying a flow cryogenic fluid, the connector having a mating surface configured for coupling to a receptacle associated with a vehicle and establishing therewith a disconnectable seal for communication of a flow of cryogenic fluid from the line to a tank in the vehicle;

a passage coupled to a source of dry purging gas for supplying a flow of dry gas to the mating surface for displacing moisture-laden air from around the mating surface, thereby preventing moisture in air from condensing on the second mating surface and freezing; and a latch for latching the connector with the receptacle on the vehicle.

8. The nozzle of claim 7 further including a boot at least partially enclosing the latch and an opening in the passage to an interior of the boot for delivering purging gas from the passage.

9. The nozzle of claim 7 wherein the latch includes a handle for working the latch and for providing additional leverage to overcome resistance to coupling of the nozzle to the receptacle due to ice formation on the connector.

10. The nozzle of claim 9 wherein the latch includes an latching arm adapted for grabbing the receptacle, and wherein the handle is coupled to the latching arm for moving the latching arm in a first direction generally opposite to and parallel with a direction of movement of the nozzle during coupling for assisting coupling.

11. The nozzle of claim 10 wherein the latching arm and handle are adapted such that, during uncoupling of the nozzle from the receptacle, moving the handle in a second direction opposite the first direction pushes the latching arm against a stop associated with the receptacle to assist in overcoming a force associated with freezing of moisture on the mating surfaces of the connector.

12. The nozzle of claim 7 wherein the connector includes a sleeve adapted for receiving within an interior spaced defined by inside surfaces of the sleeve an extension of the receptacle, the mating surface including the inside surfaces of the sleeve; and wherein the passage includes an opening for delivering a flow of purge gas to the interior of the sleeve tending to displace moisture-laden air from adjacent the inside surfaces of the sleeve.

13. The nozzle of claim 12 wherein the flow of purge gas to the interior of the sleeve tends to displace air from adjacent exterior surfaces of the extension of the receptacle that mate with the connector during coupling of the connector with the receptacle.

14. The nozzle of claim 7 further including a second connector coupled to a vent line for returning vapor phase natural gas from the fueling tank during dispensing, the second connector adapted for coupling with the receptacle.

15. The nozzle of claim 7 wherein the dry purging gas is vapor phase natural gas collected from vaporization of the LNG.

16. A refueling facility for dispensing of liquified natural gas (LNG) into motor vehicle comprising:

a supply tank storing a supply of LNG for dispensing into motor vehicles; and a dispenser coupled for receiving a flow of LNG from the supply tank, the dispenser including:

a line for carrying cryogenic fluid to a nozzle;

a fueling nozzle, the fueling nozzle including:

a connector coupled to the line for carrying a flow cryogenic fluid, the connector having mating surfaces configured for coupling to a vehicle receptacle associated with a tank in the motor vehicle and establishing therewith a disconnectable seal for communication of a flow of cryogenic fluid to the vehicle's tank;

a passage couple to a source of dry purging gas for supplying a flow of dry gas to the mating surfaces for displacing air from around the mating surfaces, thereby tending to prevent moisture in the air from condensing on the mating surfaces and freezing; and a latch for latching the connector with the vehicle receptacle.

17. The refueling facility of claim 16 wherein the dispenser further includes an LNG circulation system for pre-cooling the dispenser prior to dispensing of LNG to the motor vehicle to reduce vaporization of the LNG during dispensing, the circulation system including a dispenser receptacle adapted for coupling with the nozzle to receive a pre-cooling flow of LNG pumped from the supply tank and through the line and nozzle, the dispenser receptacle coupled to the supply tank for returning the pre-cooling flow of LNG.

18. The refueling facility of claim 17 wherein the dispenser receptacle includes an opening for delivering a flow of dry purging gas from a supply of purging gas; the flow of purging gas tending to displace air from mating surfaces of the dispenser receptacle that mate with the connector of the nozzle during coupling to assist preventing moisture in air from freezing to the mating surfaces.

19. The refueling facility of claim 18 wherein the dispenser receptacle further includes an enclosure for at least partially enclosing the receptacle in order to assist trapping of dry purging gas around the mating surfaces.

20. The refueling facility of claim 16 wherein the connector of the nozzle includes a sleeve adapted for receiving within an interior spaced defined by inside surfaces of the sleeve an extension of the vehicle receptacle, the mating surface including the inside surfaces of the sleeve; and wherein the passage includes an opening for delivering a flow of purge gas to the interior of the sleeve tending to displace air from adjacent the inside surfaces of the sleeve.

21. The refueling facility of claim 20 further including a boot at least partially enclosing the latch and an opening to an interior of the boot for delivering purging gas from the passage and displacing air containing moisture from around moving parts of the latch.

22. A refueling facility for dispensing of liquified natural gas (LNG) into motor vehicles comprising:

a supply tank storing a supply of LNG for dispensing into motor vehicles;

a dispenser coupled for receiving a flow of LNG from the supply tank, the dispenser including:

a line for carrying cryogenic fluid to a nozzle;

the fueling nozzle, the fueling nozzle including:

a first connector coupled to the line for carrying a flow cryogenic fluid, the connector having first mating surfaces configured for coupling to a vehicle receptacle associated with a tank in the motor vehicle and establishing therewith a disconnectable seal for communication of a flow of cryogenic fluid;

a second connector coupled to a vent line for venting gas from the vehicle's tank, the second connector having second mating surfaces configured for coupling to the vehicle receptacle;

a passage couple to a source of dry purging gas for supplying a flow of dry gas to the first and second mating surfaces for displacing air from around the first and second mating surfaces, thereby preventing moisture in the air from condensing on the mating surfaces and freezing;

a latch for latching the fueling nozzle with the vehicle receptacle; and a boot at least partially enclosing the latch and an opening in the passage to an interior of the boot for delivering a flow of dry purging gas for displacing air containing moisture from around moving parts of the latch;

an LNG recirculation system for pre-cooling the dispenser prior to dispensing of LNG to a vehicle to reduce vaporization of the LNG during dispensing, the recirculation system including a receptacle on the dispenser adapted for coupling with the nozzle to receive a pre-cooling flow of LNG from the supply tank and through the line and nozzle, the dispenser receptacle coupled to the supply tank for returning the pre-cooling flow of LNG.

23. The refueling facility of claim 22 wherein the dispenser receptacle includes a stop; and wherein, during uncoupling of the nozzle from the receptacle, the handle moves the latching arm in a second direction generally opposite the first direction to push against the stop to assist in overcoming resistance to uncoupling associated with freezing of moisture on the mating surfaces of the connector.

* * * * *